US008480079B2

(12) United States Patent
Sugano et al.

(10) Patent No.: US 8,480,079 B2
(45) Date of Patent: Jul. 9, 2013

(54) SHEET REVERSING APPARATUS, IMAGE FORMING APPARATUS AND SHEET REVERSING METHOD

(75) Inventors: Masashi Sugano, Hachioji (JP); Akinori Kimata, Toyokawa (JP); Katsunori Takahashi, Hachioji (JP); Akifumi Isobe, Hidaka (JP); Kenji Tamaki, Tokorozawa (JP); Satoshi Shimao, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/370,703

(22) Filed: Feb. 10, 2012

(65) Prior Publication Data

US 2012/0217698 A1 Aug. 30, 2012

(30) Foreign Application Priority Data

Feb. 24, 2011 (JP) ..... 2011-038624

(51) Int. Cl.
*B65H 5/00* (2006.01)
*B65H 29/00* (2006.01)

(52) U.S. Cl.
USPC ..... 271/225; 271/227; 271/184; 271/186

(58) Field of Classification Search
USPC ..... 271/225, 227, 184, 185, 186
See application file for complete search history.

(56) References Cited

U.S. PATENT DOCUMENTS

| | | | | |
|---|---|---|---|---|
| 4,473,425 | A * | 9/1984 | Baughman et al. | 156/356 |
| 4,540,458 | A * | 9/1985 | Baughman et al. | 156/312 |
| 4,844,442 | A * | 7/1989 | Gammerler | 271/225 |
| 5,205,551 | A * | 4/1993 | Nagano et al. | 271/225 |
| 5,362,039 | A * | 11/1994 | Kusters | 271/225 |
| 2003/0107169 | A1* | 6/2003 | Rider | 271/225 |
| 2006/0071414 | A1* | 4/2006 | Kawatsu et al. | 271/225 |
| 2011/0215522 | A1* | 9/2011 | deJong et al. | 271/225 |

FOREIGN PATENT DOCUMENTS

| | | |
|---|---|---|
| JP | 2008-230733 A | 10/2008 |
| JP | 2010-64820 A | 3/2010 |

* cited by examiner

*Primary Examiner* — David H Bollinger
(74) *Attorney, Agent, or Firm* — Cantor Colburn LLP

(57) ABSTRACT

A sheet reversing apparatus including: a right angle reversing conveyance section which reverses front/back sides of a sheet while changing a conveyance direction of the sheet, being conveyed in a first conveyance direction, to a second conveyance direction perpendicular to the first conveyance direction; a sheet skew sensor which detects a sheet skew of the sheet being conveyed by the right angle reversing conveyance section; and a sheet skew correction mechanism which corrects the sheet skew of the sheet while the sheet is being conveyed by the right angle reversing conveyance section.

6 Claims, 8 Drawing Sheets

SHEET REVERSING APPARATUS, IMAGE FORMING APPARATUS AND SHEET REVERSING METHOD

CROSS REFERENCE TO RELATED ED APPLICATION

The present application is based on Japanese Patent Application No. 2011-038624 filed with Japanese Patent Office on Feb. 24, 2011, the entire content of which is hereby incorporated by reference.

BACKGROUND OF THE INVENTION

1. Technical Field

The present invention relates to a sheet reversing apparatus, an image forming apparatus, and a sheet reversing method.

2. Background Technology

A sheet handling apparatus, such as an image forming apparatus, conveys the sheet in the apparatus, performs an image formation and the like, and further conveys the sheet performed with the image formation in the apparatus. In the case of conveying the sheet, in order to improve the conveyance efficiency, the sheet handling apparatus generally conveys the sheet with lateral feeding by setting a long edge of the sheet at the leading edge of the conveyance direction. However, in cases where the size in long edge of the sheet becomes large, the conveyance becomes difficult due to size restriction in the apparatus, therefore, for the sheet of larger size than a prescribed size, the sheet conveyance with longitudinal feeding, by setting the short edge of the sheet at the leading edge of the conveyance direction, is required.

In the meantime, in case of feeding the sheet in the apparatus, if a skew or misalignment of the sheet arises, images may not properly formed on the sheet, sheet jams may arise, and proper processing may become difficult in a post-processing after the image formation. Therefore, means for detecting the sheet position or sheet skew and connecting the skew or the misalignment of sheet are conventionally implemented (please refer to Patent document 1: JPA2008-230733 and Patent document 2: JPA2010-64820).

Skew correction mechanisms of the sheet will be described referring to rough example drawings of FIGS. 9*a* and 9*b*. In FIG. 9*a*, at the downstream side of front/back reversing conveyance section 60, which is provided with a reversing mechanism for front/hack sides reversing of sheet P, two independent guide rollers 61*a* and 61*b* are arranged along a perpendicular direction to the conveyance direction of sheet P, and said guide rollers 61*a* and 61*b* are independently driven by correction motors 62*a* and 62*b*, which enables the conveyance of sheet P. Further, near in the downstream of the guide rollers 61*a* and 61*b*, sheet skew detection sensors 63*a* and 63*b* are arranged, on a sheet conveyance path, along a perpendicular direction to the conveyance direction of sheet P, which detect the leading of sheet P being conveyed.

In this skew correction mechanism, sheet skew detection sensor 63*a* and 63*b* detect the leading edge of sheet P conveyed on the sheet conveyance path by guide rollers 61*a* and 61*b* which rotate at a constant speed. As the result of detection, if a difference of detection times is not detected between detection sensors 63*a* and 63*b*, sheet skew is determined to be not existing, and if the difference is detected, sheet skew is determined to be existing. In cases where the sheet skew is existing, by adjusting the rotation speeds of sheet skew correction motors 62*a* and 62*b* based on the above detection result, the correction mechanism sets a difference between the rotation speeds in conveyance direction of guide rollers 61*a* and 61*b* to correct the sheet skew and convey the sheet P. In cases where the sheet skew does not exist, the correction mechanism rotates guide rollers 61*a* and 61*b* in a constant speed by sheet skew correction motors 62*a* and 62 to convey the sheet P.

In FIG. 9*b*, at the downstream side of front/back reversing conveyance section 65, two guide rollers 66*a* and 66*b* are arranged along a perpendicular direction to the conveyance direction of sheet P, and said guide rollers 66*a* and 66*b* are mounted on a common drive shaft 67 to convey sheet P. Drive shat 67 is driven by sheet skew correction motor 68. Sheet skew correction motor 68 enables a change of conveyance direction by drive shaft 67, through rotating drive shaft 67 by a prescribed amount in a surface direction of the sheet.

Further, near in the downstream of the guide rollers 66*a* and 66*b*, sheet skew detection sensors 69*a* and 69*b* are arranged, on a sheet conveyance path, along a perpendicular direction to the conveyance direction of sheet P, which detect the leading of sheet P being conveyed.

In this skew correction mechanism, sheet skew detection sensor 69*a* and 69*b* detect the leading edge of sheet P. As the result of detection, if a difference of detection times is not detected between detection sensors 69*a* and 69*b*, sheet skew is determined to be not existing, and if the difference is detected, sheet skew is determined to be existing. In cases where the sheet skew is existing, by adjusting the angle of drive shaft 67 in the sheet surface direction by sheet skew correction motor 68 based on the above detection result, the correction mechanism rotates guide rollers 66*a* and 66*b* rotatably mounted on drive shaft 67 by sheet skew correction motor 68 at a constant speed, and to convey the sheet P by correcting the sheet skew. In cases where the sheet skew does not exist, the correction mechanism positions drive shaft 67 along the direction perpendicular to the sheet conveyance direction, and rotates guide rollers 61*a* and 66*b* in a constant speed by sheet skew correction motors 68 to convey the sheet P.

Problems to be Solved by the Invention

In the sheet conveyance with longitudinal feeding by setting the short edge of the sheet at the leading edge of the conveyance direction, since the sheet skew correction is executed within the width of short edge, a small amount of displacement causes a large sheet skew correction, which makes it difficult to ensure the correction accuracy.

Particularly in the area of PP (production Printing), due to a usage of sheets having been cut from an image formed sheet or due to diversified commercial print materials, requirement of using a conventionally unexpected large sized sheet is increasing, which causes a problem of difficulty in suppressing the sheet skew within an allowable range.

The present invention is accomplished in view of the above background, and its objective is to provide a sheet reversing apparatus, an image forming apparatus and a sheet reversing method that enable to correct the sheet skew with high accuracy even in the case of conveying sheet with longitudinal feeding.

SUMMARY OF THE INVENTION

To achieve at least one of the above mentioned objects, a sheet reversing apparatus includes a right angle reversing conveyance section which reverses front/back sides of a sheet while changing a conveyance direction of the sheet, being conveyed in a first conveyance direction, to a second conveyance direction perpendicular to the first conveyance direction; a sheet skew sensor which detects a sheet skew of the sheet being conveyed by the right angle reversing conveyance section; and a sheet skew correction mechanism which corrects the sheet skew of the sheet while the sheet is being conveyed by the right angle reversing conveyance section.

The above sheet reversing apparatus is preferable to be further provided with a control section which controls a correction movement by the sheet skew correction mechanism based on a detection result of the sheet skew sensor.

In the above sheet reversing apparatus, it is preferable for the control section to control the sheet skew correction mechanism so as to correct only the sheet skew of the sheet, which is conveyed in the right angle reversing conveyance section with lateral feeding by setting a long edge of the sheet at a leading edge of conveyance direction.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Next, an embodiment of the present invention will be described.

Figure 1:
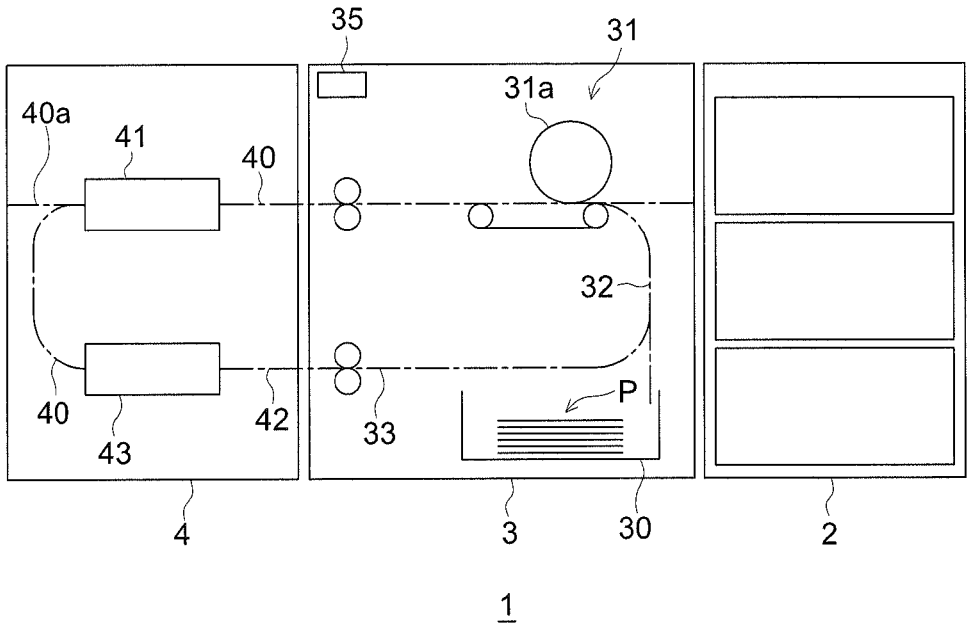
FIG. 1 is a diagram showing an outline of mechanical configuration of an image forming apparatus relating to an embodiment of the present invention.

FIG. 1 is a drawing to show the outline of image forming apparatus of the present invention. Image forming apparatus 1 is provided with large capacity sheet feeding apparatus 2, image forming apparatus main body 3, and fixing apparatus 4. Large capacity sheet feeding apparatus 2 and image forming apparatus main body 3 are connected such that sheet conveyance from large capacity sheet feeding apparatus 2 to image forming apparatus main body 3 and sending/receiving of signals are enabled. Further, image forming apparatus main body 3 and fixing apparatus 4 are connected such that sheet conveyance from image forming apparatus main body 3 to fixing apparatus and sending/receiving of signals are enabled.

Meanwhile, as the present invention, image forming apparatus 1 may be configured with only image forming apparatus main body 3 and fixing apparatus 4, or may be connected with other peripheral apparatuses.

Large capacity sheet feeding apparatus 2 is provided with one or more sheet feeding cassette to accommodate sheets, and is capable of feeding the sheet accommodated in the cassette to image forming apparatus main body 3.

Image forming apparatus main body 3 is provided with sheet feeding section 30 including a sheet feeding tray, image forming section 31 to form an image on the sheet, image forming conveyance section 32 to convey the sheet, return conveyance section 33 that joins together with image forming conveyance section 32, and control section 35 to control all the image forming apparatus.

Image forming conveyance section 32 extends from sheet feeding section 30 to image forming section 31, and further to fixing section 4 for conveying the sheet. Image forming conveyance section 32 extends still further to the side of large capacity sheet feeding apparatus 2 for receiving the sheet supplied by large capacity sheet feeding apparatus 2 and conveying into image forming apparatus main body 3. Return conveyance section 33 receives the sheet returned from fixing apparatus 4, and sends the sheet to image forming conveyance section 32.

Based on image data, image forming section 31 forms a toner image onto the sheet. The image forming apparatus is provided with an exposing unit and a charging unit and a developing unit (which are not illustrated).

The charging unit uniformly charges the surface of photosensitive drum 31*a*. The exposure unit exposes a surface of the photosensitive drum with a laser beam scanning corresponding to output information outputted from control section based on the image data, and forms a latent image. The developing unit develops to visualize the latent image on photosensitive drum 31*a* with toner image.

Fixing unit 4 is provided with fixing conveyance section 40 connected with image forming conveyance section 32, and fixing section 41 is disposed on fixing conveyance section 40. At the downstream side of fixing section 41, fixing conveyance section 40 branches off sheet ejection conveyance section 40*a* that extends to a sheet ejection section outside the fixing unit 4, and at the downstream side of fixing conveyance section 40, right angle reversing conveyance section 43 is connected. At the downstream side of right angle reversing conveyance section 43, return conveyance section 42 is connected, and said return conveyance section 42 is connected to return conveyance section 33 in image forming apparatus main body 3.

Image forming conveyance section 32 and fixing conveyance section 40 correspond to the sheet conveyance section of the present invention.

Figure 2:
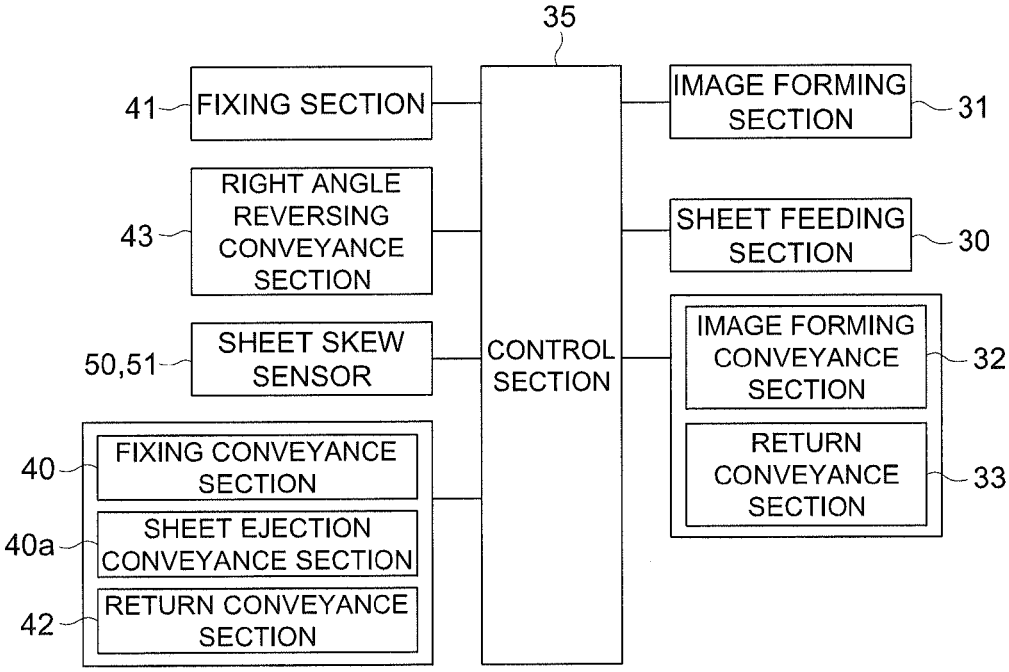
FIG. 2 is a diagram showing a control block of the image forming apparatus.

Control block of the abovementioned image forming apparatus 1 will be described based on FIG. 2. Image forming apparatus 1 is totally controlled by control section 35. Control section 35 is mainly configured with a CPU and programs to operate it, and provided with a RAM for a working area, a nonvolatile memory storing operation parameter of each part of image forming apparatus and the like.

To control section 35, sheet feeding section 30 and image forming section 31, which are provided in image forming apparatus main body 3, are connected in controllable manner. Further, image forming conveyance section 32 and return conveyance section 33 are controllably connected to control section 35, and the sheet conveyance in image forming apparatus main body is controlled by control section 35. Meanwhile, image forming conveyance section 32 and return conveyance section 33 are capable of the longitudinal feeding with short edge of the sheet being at leading edge in conveyance direction, and the lateral feeding with long edge of the sheet being at leading edge of conveyance direction, however, are capable of only the longitudinal feeding for the larger sheet than a prescribed size due to the space restriction in the apparatus.

Control section 35 controls to feed a prescribed sheet from sheet feeding section 30 based on the job data, convey the sheet by image forming conveyance section 32, and form an image based on the image data included in the job data by image forming section 31. Wherein, in cases where an operation to convey the sheet, with larger size than a prescribed size, by lateral feeding is conducted, control section 35 prohibits the sheet conveyance from sheet feeding section 30.

Further, fixing conveyance section 40, sheet ejection conveyance section 40*a* and return conveyance section 42, which are in fixing apparatus 4, are connected to control section 35 in controllable manner, and conveyance of sheet P in fixing apparatus 4 is controlled by control section 35. Fixing conveyance section 40, sheet ejection conveyance section 40*a* and return conveyance section 42 are capable of the longitudinal feeding with short edge of the sheet being at leading edge of conveyance direction, and the lateral feeding with long edge of the sheet being at leading edge of conveyance direction, however, are capable of only the longitudinal feeding for the larger sheet than a prescribed size due to the space restriction in the apparatus.

Further, to control section 35, fixing section 41 is controllably connected. In fixing section 41, image fixing is executed for the sheet formed with an image at image forming apparatus 3 and conveyed by fixing conveyance section 40.

Right angle reversing conveyance section 43 is controllably connected to control section 35, and control section 35 controls to execute a right angle reversing for the sheet formed with an image at image forming apparatus 3 and conveyed by fixing conveyance section 40, at right angle reversing conveyance section 43.

Further, sheet skew sensors 50, 51 are controllably connected to control section 35, which detect the sheet skew of sheet P being conveyed by right angle reversing conveyance section 43. Result of the detection by sheet skew sensors 50, 51 is sent to control section 35.

Figure 3:
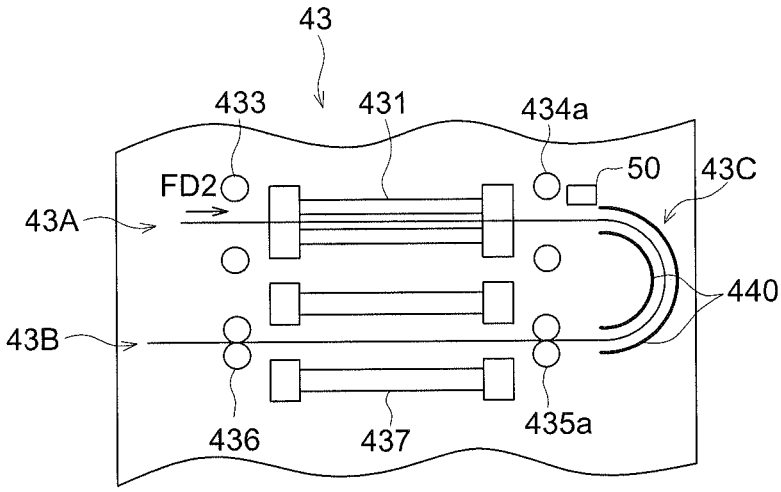
FIG. 3 is a diagram showing a side view of a right angle reversing conveyance section of the image forming apparatus.
Figure 4A:
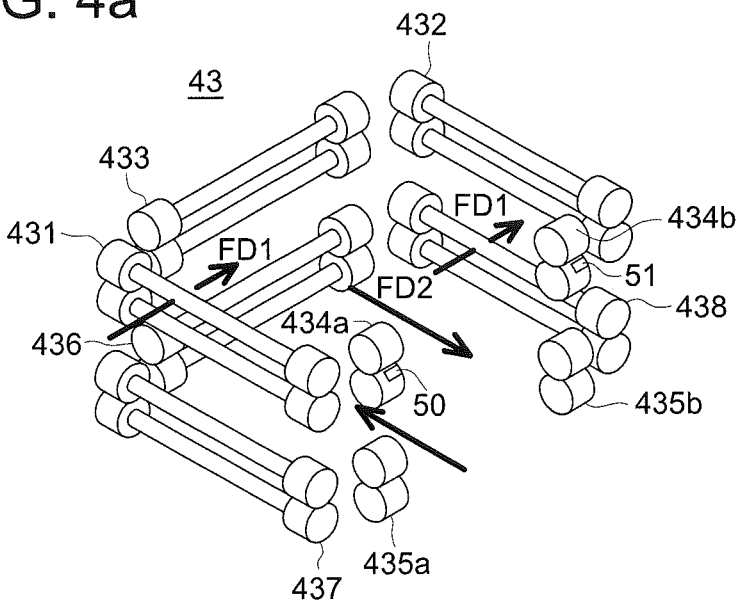
FIG. 4*a* is a perspective view of a right angle reversing conveyance section of the image forming apparatus.
Figure 4B:
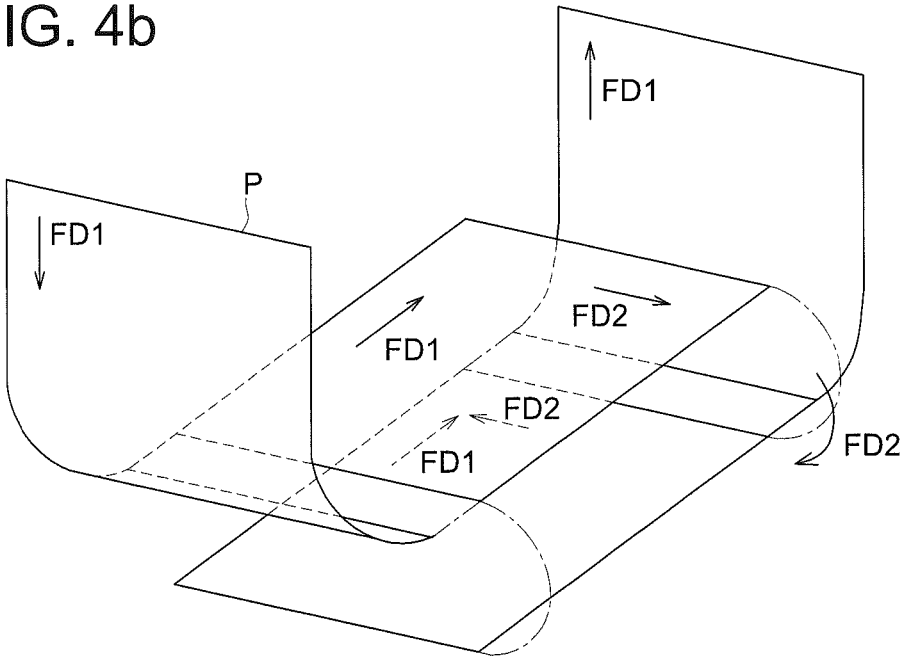
FIG. 4*b* is a perspective view showing a state of right angle reversing conveyance.

Next, the configuration of right angle reversing conveyance section 43 will be described in detail based on FIGS. 3-5. FIG. 3 is a side view of a main part of right angle reversing conveyance section 43, and FIGS. 4*a*, 4*b* are perspective views schematically illustrating the structure of right angle reversing conveyance section 43 and a sheet reversing path.

Right angle reversing conveyance section 43 is provided with a conveyance path (conveyance direction FD2 of sheet P) to convey sheet P in the perpendicular direction to sheet conveyance direction FD1 of fixing conveyance section 40. Further, right angle reversing conveyance section 43 reverses the front/back surface of the sheet P by rotating sheet P about a rotation axis parallel to the sheet conveyance direction FD1 at the position of transfer. Right angle reversing conveyance section 43 is provided with first reversing section 43A, second reversing section 43B, and rotatory conveyance path 43C.

First reversing section 43A has conveyance roller 431, conveyance roller 432, reversing roller 433, and reversing rollers 434*a*, 434*b*. Conveyance roller 431 is configured with a rotation roller and a driven roller contacting to the rotation roller, and is enabled to switch between a pressed state (nipped state) and a separate state (nip released state) by being driven with an unillustrated drive mechanism. The rotation roller is configured with a rotation axis and a pair of rollers attached at the both ends of the axis, and the driven roller is configured with a rotation axis and a pair of rollers attached at the both ends of the axis. The configuration of said conveyance roller 431 is similar to configurations of conveyance roller 432, reversing roller 433, and conveyance rollers 437, 438 to be described later. Drive motors to drive each roller are connected to control section 35 in controllable manner.

In each of conveyance rollers 431, 432, rotation axes of the rollers are respectively arranged in parallel to sheet conveyance direction FD2, both conveyance rollers 431, 432 are arranged in parallel across a prescribed distance from each other, the prescribed distance being within the length of sheet P in conveyance direction.

Each of reversing rollers 433, 434*a*, 434*b* is arranged at both ends side of conveyance rollers 431, 432, and has a rotation axis parallel to the direction perpendicular to the rotation axes of conveyance rollers 431, 432, namely parallel to the conveyance direction FD1. Reversing rollers 434*a*, 434*b* are configured with rotation rollers and driven rollers contacting to the rotation rollers, and are enabled to switch between a pressed state (nipped state) and a separate state (nip released state) by being driven with an unillustrated drive mechanism. Each of the rotation rollers is configured with a rotation axis and a roller attached on the axis, and each of the driven rollers is configured with a rotation axis and a roller attached on the axis.

Reversing rollers 433, 434*a*, 434*b* are arranged in parallel across a prescribed distance from each other, the prescribed distance being within the length of sheet P in conveyance direction.

Reversing rollers 434*a*, 434*b* are respectively connected to independent drive motors with each other, and rotation speed of each reversing rollers 434*a*, 434*b* is enabled to be separately set. Each of drive motors to rotate reversing rollers 434*a*, 434*b* is controllably connected to control section 35. Reversing rollers 434*a*, 434*b* are capable of adjusting the sheet skew of the sheet being conveyed by changing the rotation speed of each drive motor. Therefore, reversing rollers 434*a*, 434*b*, and each drive motor which separately drive these rollers constitute the sheet skew correction mechanism of the present invention.

The configuration of said reversing rollers 434*a*, 434*b* is similar to configurations of reversing rollers 435*a*, 435*b* to be described later.

Further, at the downstream position in conveyance direction FD2 of reversing rollers 431*a* and 431*b*, two sheet skew sensors 50, 51 are arranged with an interval in the direction perpendicular to conveyance direction FD2.

Conveyance rollers 431, 432 receive the sheet having passed through the fixing position from fixing conveyance section 40, and convey the sheet up to a first switching position for switching from sheet conveyance direction FD1 to the sheet conveyance direction FD2 of right angle reversing conveyance section 43. The first switching section is a position where reversing rollers 433, 434*a*, 434*b*, can nip and convey the sheet P, having been conveyed by conveyance rollers 431, 432, toward rotatory conveyance path 43C.

Reversing rollers 433, 434*a*, 434*b* convey the sheet P, having been conveyed to the first switching position by conveyance rollers 431, 432, according to the sheet conveyance direction FD2. Specifically, in cases where sheet skew correction is not required, reversing rollers 433, 434*a*, 434*b* convey the sheet with the same rotation speed for each reversing rollers 434*a* and 434*b*, and supply the sheet P to the second reversing position 43B via rotatory conveyance path 43C. While, in cases where sheet skew correction is required at rotatory conveyance path 43C, reversing rollers 434*a*, 434*b* correct the sheet skew by conveying the sheet P with respectively different rotation speed.

That is to say fixing apparatus 4 is provided with a mechanism as the sheet reversing apparatus of the present invention. In the present embodiment, control section 35 executes the correction movement of the sheet skew correction mechanism, and control section 35 functions as a controller of the sheet reversing apparatus. In the present invention, the controller for executing the correction movement of the sheet skew correction mechanism may be independently provided at the side of fixing apparatus.

Figure 5:
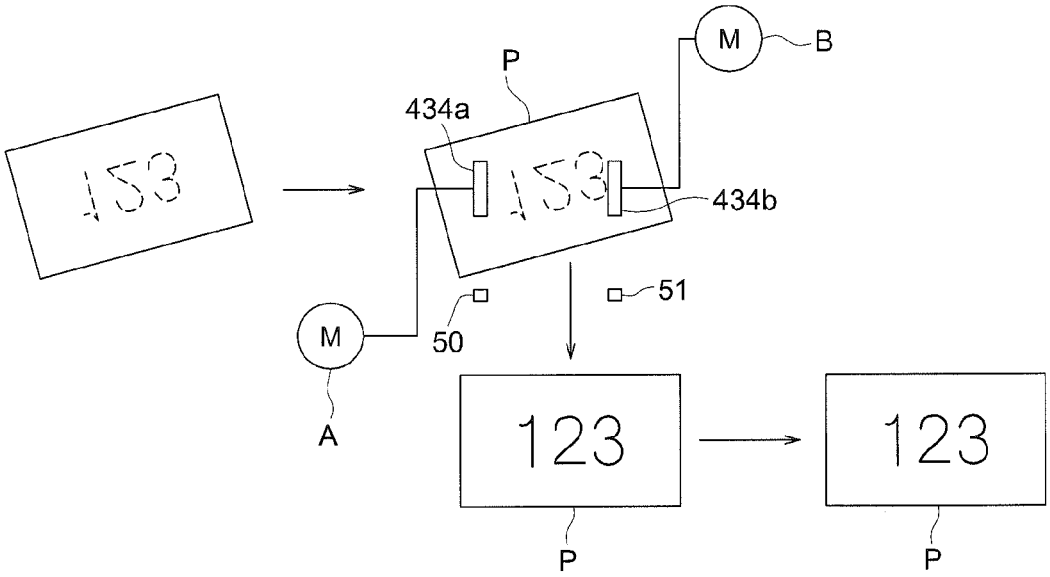
FIG. 5 is a schematic plan view showing a state of right angle reversing conveyance at the right angle reversing conveyance section of the image forming apparatus.

FIG. 5 is a drawing to explain a state where sheet P conveyed in longitudinal feeding is switched to lateral feeding by right angle reversing conveyance section 43, and the sheet skew is corrected by reversing rollers 434*a* and 434*b*. In FIG. 5, reversing roller 434*a* is connected to drive motor A, and reversing roller 434*b* is connected to drive motor B. At right angle reversing conveyance section 43, sheet P is conveyed by reversing roller 434*a* driven by drive motor A and reversing roller 434*b* driven by drive motor B. The sheet skew is detected by sheet skew sensor 50, 51 during the conveyance. The detection result is sent to control section 35. Control section 35 calculates the amount of sheet skew of sheet P from the difference of detection time between sheet skew sensor 50 and 51 and the conveyance speed of the sheet. In control section 35, the amount of sheet skew and the correction amount by reversing rollers 434*a*, 434*b*, namely the respective rotation speed of reversing rollers 434*a*, 434*b*, are previously correlated and stored, and according to the detection result, the respective rotation speed of reversing rollers 434*a*, 434*b* for correcting the sheet skew are set. As the result, the sheet skew of sheet P being conveyed by right angle reversing conveyance section 43 is corrected, and sheet P is returned in longitudinal feeding to return conveyance section.

Returning to the explanation of FIG. 3 and FIGS. 4*a*, 4*b*, rotatory conveyance path 43C is disposed between the carrying-out side of reversing rollers 435*a*, 435*b* of second reversing section 43B and the carrying-in side of reversing rollers 434*a*, 434*b* of first reversing section 43A, and sheet skew sensors 50, 51 are arranged on rotatory conveyance path 43C.

Rotatory conveyance path 43C is, for example, configured with a pair of guide plate 440 made of metallic material and curved outward in arc. Therefore, by passing between the pair of guide plate 440, sheet P is rotates by 180 degrees to be front/back sides reversed centering with a rotation axis parallel to sheet conveyance direction FD1 at the transfer position.

Second reversing section 43B has reversing rollers 435*a*, 435*b*, 436, and conveyance rollers 437, 438. Configurations of reversing rollers 435; 435*b* are similar to those of reversing rollers 434; 434*b* in the first reversing section 43A, and configuration of reversing rollers 436 is similar to that of reversing roller 433, in the first reversing section 43A. Configurations of conveyance rollers 437, 438 are similar to those of conveyance rollers 431, 432 in the first reversing section 43A, therefore, the explanation for overlapped parts will be omitted.

Similar to reversing rollers 434; 434*b*, right and left reversing rollers 435; 435*b* are respectively connected to independent drive motors, and rotation speed of each of reversing rollers 435; 435*b* is capable of being separately set. Drive motors to drive reversing rollers 434*a*, 434*b* are controllably connected to control section 35. Reversing rollers 434; 434*b* are capable of correcting the skew of the sheet being conveyed, by changing the rotation speed of each drive motors. Therefore, reversing rollers 435; 435*b*, and each drive motor which separately drive these rollers constitute the sheet skew correction mechanism of the present invention.

After receiving the sheet P conveyed along rotatory conveyance path 43C, in cases where the sheet skew correction of the sheet is not required, reversing rollers 435*a* and 435*b* convey the sheet P to the second switching position for switching from sheet conveyance direction FD2 of right angle reversing conveyance section 43 to sheet conveyance direction FD1, while rotating the respective rollers with a same speed. The second switching position is located so that conveyance rollers 437 and 438 are capable of nipping the sheet P conveyed by reversing rollers 435; 435*b* and 436 and conveying to the conveyance path in return conveyance section 42.

In this way, differently from a switch back means, right angle reversing conveyance section 43 reverses the front/back sides of sheet P without interchanging the leading/trailing edges of sheet as shown in FIG. 4*b* and FIG. 5. By passing through right angle reversing conveyance section 43, the reversed sheet is returned to return conveyance section 42 being reversed in the front/back sides. The sheet returned to return conveyance section 42 is further returned to return conveyance section 33 of image forming apparatus 3, to be capable of image formation on the back surface.

Figure 6:
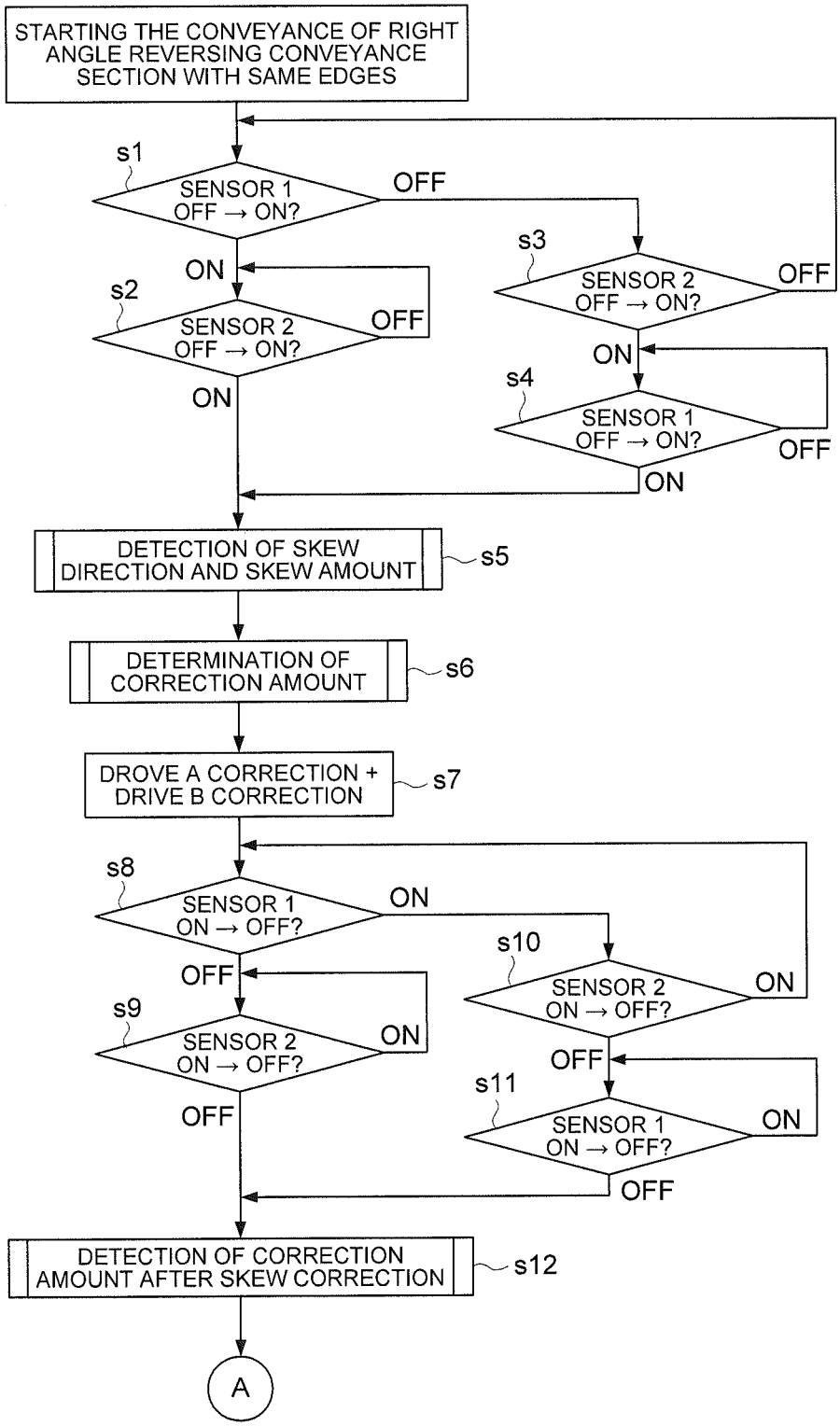
FIG. 6 is a flow chart showing a part of procedure for sheet skew correction at the right angle reversing conveyance section of the image forming apparatus.
Figure 7:
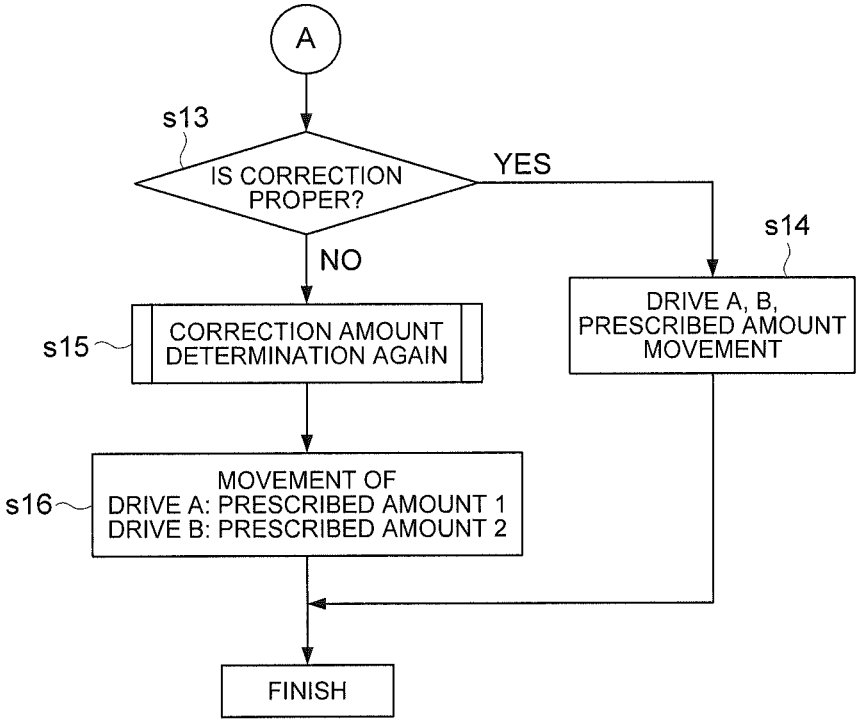
FIG. 7 is a flow chart showing another part of the procedure for sheet skew correction at the right angle reversing conveyance section of the image forming apparatus.

Next, procedures of right angle reversing conveyance and sheet skew correction of the sheet will be explained based on flow charts of FIGS. 6 and 7. In these flow charts, sheet skew sensor 50 is shown as sensor 1, and sheet skew sensor 51 is shown as sensor 2. With the start of right angle reversing conveyance by right angle reversing conveyance section 43, the sheet edge detection by sensors 1 and 2 are started, and the detection results are sent to control section 35. Sensors 1 and 2 are reflection type sensors and output ON signals in case of detecting the sheet, and output OFF signals in case of not detecting the sheet.

Firstly, determined is whether the detection result of sensor 1 changed from OFF to ON or not (step s1). In the case where detection result stays OFF in sensor 1 and sheet edge being not detected (step s1, OFF), determined is whether the detection result of sensor 2 changed from OFF to ON or not (step s3). In the case where detection result stays OFF in sensor 2 and sheet edge being not detected (step s3, OFF), the procedure returns to step s1 to continue the sheet edge detection.

In the case where the detection result of sensor 2 changed from OFF to ON and sheet edge having been detected (step s3, ON), determined is whether the detection result of sensor 1 changed from OFF to ON or not (step s4). In the case where detection result stays OFF in sensor 1 and sheet edge being not detected (step s4, OFF), the detection is continued until changing from OFF to ON in sensor 1. In the case where the detection result of sensor 1 changed from OFF to ON and sheet edge having been detected, a skew direction and a skew amount are detected based on the detection results (step s5).

In the case where the detection result of sensor 1 changed from OFF to ON and sheet edge having been detected (step s1, ON), determined is whether the detection result of sensor 2 changed from OFF to ON or not (step s2). In the case where detection result stays OFF in sensor 2 and sheet edge being not detected (step s2, OFF), the detection is continued until changing from OFF to ON in sensor 2. In the case where the detection result of sensor 2 changed from OFF to ON and sheet edge having been detected (step s2, ON) a skew direction and a skew amount are detected based on the detection results (step s5).

Control section 35 can detect the skew direction and skew amount by a time difference of respective detection timing by sensors 1 and 2, and a conveyance speed.

According to the skew amount, control section 35 determines the correction amount by reversing rollers 434*a* and 434*b*, by specifically determining respectively changed rotation speeds and conveyance period with the changed rotation speeds (step s6). Relationship between the skew amount and the correction amount is preferably stored previously in a nonvolatile memory, and the correction amount can be determined by reading out this according to the detection result.

Control section 35 controls to execute the correction by drive motor A and drive motor B based on the control amount (step s7).

Subsequently, the sheet edge in trailing side of conveyed sheet P is detected by sheet skew sensor 50 (sensor 1) and sheet skew sensor 51 (sensor 2).

Namely, after the step s7, determined is whether the detection result of sensor 1 changed from ON to OFF or not (step s8). In the case where detection result stays ON in sensor 1 (step s8, ON), determined is whether the detection result of sensor 2 changed from ON to OFF or not (step s10). In the case where detection result stays ON in sensor 2 (step s10, ON), returning to step s8 and continues to detect the sheet edge.

In the case where the detection result of sensor 2 changed from ON to OFF and sheet edge having been detected (step s10, OFF), determined is whether the detection result of sensor 1 changed from ON to OFF or not (step s11). In the case where detection result stays ON in sensor 1 and sheet edge being not detected (step s11, ON), the detection is continued until changing from ON to OFF in sensor 1. In the case where the detection result of sensor 1 changed from ON to OFF and sheet edge having been detected (step s11, OFF), a correction amount is detected from a skew direction and a skew amount after the skew correction based on the detection results (step s12).

In the case where the detection result of sensor 1 changed from ON to OFF and sheet edge having been detected (step s8, OFF), determined is whether the detection result of sensor 2 changed from ON to OFF or not (step s9). In the case where detection result stays ON in sensor 2 and sheet edge being not detected (step s9, ON), the detection is continued until changing from ON to OFF in sensor 2.

In the case where the detection result of sensor 2 changed from ON to OFF and sheet edge having been detected (step s9, OFF), a correction amount is detected from a skew direction and a skew amount after the skew correction based on the detection results (step s12).

After the correction amount detection, whether the correction is properly executed or not is determined (step s13). In said determination, for example, a predetermined threshold value is previously stored, and in a case where the correction amount is within the threshold value, the correction is judged to be proper, while in a case where the correction amount is beyond the threshold value, the correction is judged to be required of further correction.

When the correction is judged to be proper (step s13, Yes), reversing rollers 435*a*, 435*b* conveys the sheet by a prescribed amount of drive operation with the same speed (step s14).

While, when the correction is judged to be not proper (step s13, No), control section 35 determines correction values in reversing rollers 435*a* and 435*b* (step s15), sets respective drive amount of reversing rollers 435*a* and 435*b*, and executes the conveyance operation. By reversing rollers 435*a* and 435*b* whose respective rotation speeds are different, the sheet skew of sheet P is corrected again to perform a further assured sheet skew correction (step s16).

Further, by referring to the sheet skew direction and skew amount obtained by the trailing edge detection, the relationship of the correction amount with respect to the sheet skew direction and skew amount at the leading edge detection may be corrected to improve the accuracy of the sheet skew correction at the leading edge detection.

In the above described procedures, after correcting the sheet skew by detecting the leading edge, the sheet skew correction is further executed by detecting the trailing edge of the sheet, however according to the present invention, the sheet skew correction may be executed by detecting only the leading edge of the sheet.

Further, in the above described control procedure, the sheet skew correction is executed regardless of longitudinal or lateral direction in sheet conveyance direction, however in right angle reversing conveyance section 43, the sheet skew may be detected and corrected only in the case of longitudinal feeding of the sheet being conveyed in the fixing conveyance section.

In this case, sheet skew sensors 50, 51 in right angle reversing conveyance section 43 are assumed as second sheet skew sensors, and the sheet skew correction mechanism configured with reversing rollers 434*a*, 434*b* and each drive motors to separately drive these reversing rollers is assumed as a second sheet skew correcting mechanism. And by providing a first sheet skew sensor and a first sheet skew correction mechanism, in image forming conveyance section 32 or fixing conveyance section 40, in cases where the sheet is conveyed with lateral feeding in image forming conveyance section 32 or fixing conveyance section 40, the sheet skew correction may be executed by the first sheet skew sensor and the first sheet correction mechanism and not be executed at the second sheet skew correction mechanism of right angle reversing conveyance section 43. By this, the sheet skew can be accurately corrected according to the longitudinal or lateral sheet feeding direction.

Further, although in the above described embodiment, right angle reversing conveyance section 43 is explained with the assumption of being provided in fixing apparatus 4, said right angle reversing conveyance section 43 may be provided in image forming apparatus main body 3, and further said right angle reversing conveyance section 43 may be provided in other peripheral apparatus which is directly or indirectly connected to said image forming apparatus main body 3. However, by providing said right angle reversing conveyance section 43 at a place, having a room of space, outside of image forming apparatus main body 3, it becomes possible to suppress the conveyance width of image forming apparatus main body 3 to minimum.

In the above, although the present invention is explained based on the above embodiment, the present invention should not be restricted to the explanation of the embodiment, and is arbitrarily changeable without departing from the scope of the present invention.

According to the present invention, at the time of reversing the sheet front/back faces while switching and conveying the sheet being conveyed in the first conveyance direction toward the second conveyance direction perpendicular to the first conveyance direction, the sheet skew is detected. The switching of conveyance direction can be executed by the right angle reversing conveyance section and the like that drives the sheet toward the second conveyance direction perpendicular to the first conveyance direction. The right angle reversing conveyance section can be configured with rollers to convey the sheet, drive motors, and the like.

The sheet skew detection can be executed by using the sheet skew sensor, while a type of the sensor for the present invention is not restricted. For example, by providing two or more sensors in the direction crossing to the right angle conveyance direction, the sheet edge can be detected by each sensor. Usually, the sheet edge is detected at the leading edge of the sheet, however may be detected at the trailing edge, or at both the leading edge and trailing edge. The sheet skew amount can be determined by the time difference of detections at two sensors.

A plurality of sets of the sheet skew sensor and the correction mechanism may be arranged in the right angle conveyance direction of the sheet. By this, the sheet skew can be more precisely corrected.

By utilizing the detection result as correction information, the sheet skew correction mechanism can correct the sheet skew. Although the sheet skew correction by the sheet skew correction mechanism can be executed by a user operation based on the detection result of the sheet skew sensor, the correction can be more effectively executed by the control section that receives the detection result and controls the movement of the sheet skew correction mechanism.

In the present invention the sheet skew correction mechanism is only required to be capable of correcting the skew of the sheet being right angle conveyed in the second conveyance direction, and is not specifically restricted for the present invention. For example, the sheet skew can be corrected by arranging a plurality of guide rollers described in the above background technology along the direction crossing to the sheet conveyance direction and changing the rotation speeds of respective guide rollers. Further, by changing the direction of drive axis of guide rollers toward the direction different from the perpendicular direction to the conveyance direction, the skew of the sheet can be corrected.

As the above, according to the present invention, the sheet skew can be corrected while reversing front/back surfaces of the sheet without changing the leading edge to be the trailing edge (with the same edge).

The present invention can be preferably applied in cases where the sheet is conveyed with longitudinal feeding in the first conveyance direction by placing the short edge of the sheet at the leading edge of conveyance direction, the conveyance direction is switched to the second conveyance direction perpendicular to the first conveyance direction, and the sheet is conveyed with lateral feeding by placing the long edge at the leading edge of conveyance direction. At the time of correcting the sheet skew with a prescribed angle, in the case of correcting the skew of the sheet conveyed with longitudinal feeding the skew displacing amount of sheet is larger than the that in the case of lateral feeding, and sheet skew correction amount varies widely, and the higher precision correction is required for the longitudinal feeding sheet compared to the lateral feeding sheet. Namely, the correction accuracy required for the lateral feeding sheet is lower than that for the longitudinal feeding sheet.

Further, in case of using guide rollers as the sheet skew correction mechanism, the guide rollers are arranged along the direction crossing to the conveyance direction of the sheet. Therefore, the distance between each of the arranged guide rollers can be made larger in the case of lateral feeding.

Figure 8A:
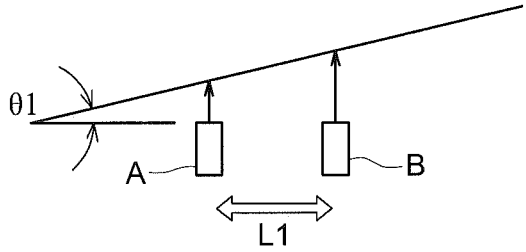
FIGS. 8*a* and 8*b* are diagrams for explaining the difference of adjusting angles between the cases of longitudinal feeding and lateral feeding.
Figure 8B:
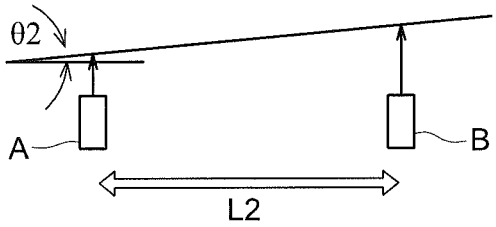
Figure 9A:
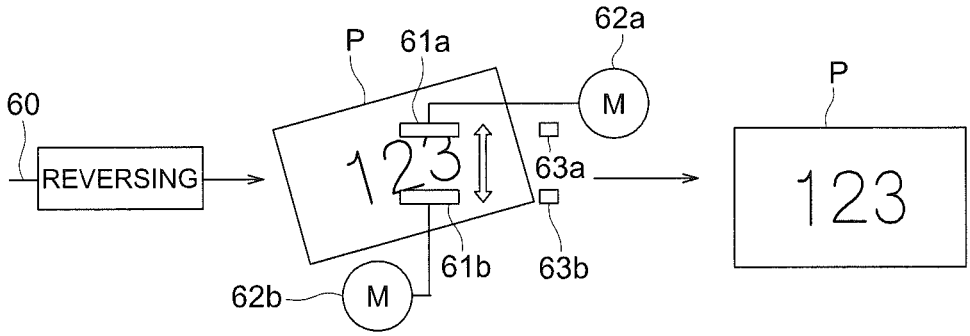
PRIOR ART FIG. 9a
FIGS. 9*a* and 9*b* respectively show examples of conventional sheet skew correction mechanisms.
Figure 9B:
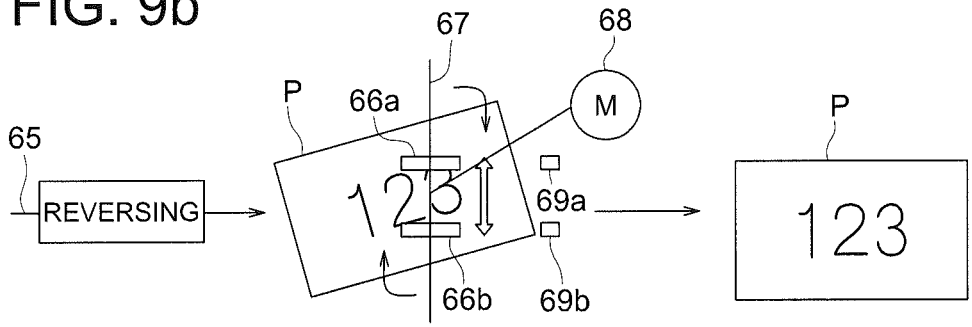

FIGS. 8*a* and 8*b* schematically show the modes of sheet skew correction by guide roller pairs with different roller intervals. In case of conveying the sheet with longitudinal feeding, it is assumed that by arranging guide rollers A, B with the interval of L1 in the direction perpendicular to the first conveyance direction, and by setting a prescribed difference of conveyance speeds between guide rollers A and B to adjust the sheet skew amount, the sheet skew amount can be adjusted with an angle of $\theta 1$.

On the other hand, in case of conveying the sheet with lateral feeding, it is assumed that by arranging guide rollers A, B with the interval of L2 in the direction perpendicular to the first conveyance direction, and by setting a prescribed difference of conveyance speeds between guide rollers A and B to adjust the sheet skew amount, the sheet skew amount can be adjusted with an angle of $\theta 2$. Wherein conditions becomes: $L1>L2$, and $\theta 2<\theta 1$. Namely, in case of adjusting the sheet skew amount by setting the same conveyance speed difference between guide rollers A and B, the case of lateral feeding can adjust in detail by setting a smaller adjusting angle than the case of longitudinal feeding. Therefore, the case of lateral feeding can perform the higher precision sheet skew correction.

Further, in the image forming apparatus of the present invention, by assuming the abovementioned sheet skew sensor to be a second sheet skew sensor, and the abovementioned sheet skew correction mechanism to be a second sheet skew correction mechanism, and by providing a first sheet skew sensor to further detect the sheet skew of the sheet being conveyed in the above-mentioned sheet conveyance section and a first sheet skew correction mechanism to correct the sheet skew during the sheet conveyance by the abovementioned sheet conveyance section, the sheet skew correction at the sheet conveyance section and the sheet skew correction at the sheet reversing apparatus may be selectively executed, or the both sheet skew corrections may be executed.

Particularly, by properly conducting the above selection according to the longitudinal or lateral sheet conveyance direction, the sheet skew correction can be performed with higher precision. Specifically, in the case of sheet conveyance at the sheet conveyance section in longitudinal feeding with placing the short edge of sheet at leading edge in the conveyance direction, without executing the sheet skew correction during the conveyance by the sheet conveyance section, and by executing the sheet skew detection and sheet skew correction at the sheet reversing apparatus where the sheet is conveyed in lateral feeding with placing the long edge of sheet at leading edge in the conveyance direction, the sheet skew correction can be performed with higher precision. On the other hand, in the case where the sheet is conveyed with lateral feeding in the sheet conveyance section, by executing the sheet skew detection and sheet skew correction at the sheet conveyance section, without executing the sheet skew correction of the sheet being conveyed in the sheet reversing apparatus, the sheet skew correction can be performed with higher precision. Meanwhile, the present invention does not preclude the mode of executing the sheet skew correction at both the sheet conveyance section and the sheet reversing section.

EFFECT OF THE INVENTION

As described above, according to the present invention, the sheet skew is corrected at the time of reversing front/back sides of the sheet while switching and conveying the sheet being conveyed in the first conveyance direction toward the second conveyance direction perpendicular to the first conveyance direction, accordingly even for the sheet being conveyed with longitudinal feeding due to large sheet size, the sheet reversing and high precision sheet skew correction are enabled.

EXPLANATION OF CODES

1. Image forming apparatus
2. Large capacity sheet feeding apparatus
3. Image forming apparatus main body
4. Fixing apparatus

31. Image forming section
32. Image forming conveyance section
35. Control section
40. Fixing conveyance section
43. Right angle reversing conveyance section
50. Sheet skew sensor
51. Sheet skew sensor
434*a*. Reversing roller,
434*b*. Reversing roller
435*a*. Reversing roller
435*b*. Reversing roller

What is claimed is:

1. A sheet reversing apparatus comprising:

a right angle reversing conveyance section which reverses front/back sides of a sheet while changing a conveyance direction of the sheet, being conveyed in a first conveyance direction, to a second conveyance direction perpendicular to the first conveyance direction;

a sheet skew sensor which detects a sheet skew of the sheet being conveyed by the right angle reversing conveyance section;

a sheet skew correction mechanism which corrects the sheet skew of the sheet while the sheet is being conveyed by the right angle reversing conveyance section; and a control section which controls a correction movement by the sheet skew correction mechanism based on a detection result of the sheet skew sensor, wherein the control section controls the sheet skew correction mechanism so as to correct only the sheet skew of the sheet which is conveyed in the right angle reversing conveyance section with lateral feeding by setting a long edge of the sheet at a leading edge of conveyance direction.

2. An image forming apparatus comprising:

an image forming section for forming an image on a sheet;

a sheet conveyance section which conveys the sheet in a first conveyance direction;

a right angle reversing conveyance section which reverses front/back sides of the sheet while changing a conveyance direction of the sheet, being conveyed by the sheet conveyance direction, to a second conveyance direction perpendicular to the first conveyance direction;

a sheet skew sensor which detects a sheet skew of the sheet being conveyed by the right angle reversing conveyance section;

a sheet skew correction mechanism which corrects the sheet skew of the sheet while the sheet is being conveyed by the right angle reversing conveyance section; and a control section which controls a correction movement by the sheet skew correction mechanism based on a detection result of the sheet skew sensor;

wherein the control section controls the sheet skew correction mechanism so as to correct only the sheet skew of the sheet which is conveyed in the right angle reversing conveyance section with lateral feeding by setting a long edge of the sheet at a leading edge of conveyance direction.

3. The image forming apparatus of claim 2, wherein with respect to the sheet having a larger long edge size than a prescribed size, the sheet conveyance section conveys the sheet with longitudinal feeding by setting a short edge of the sheet at a leading edge of conveyance direction.

4. An image forming apparatus comprising:

an image forming section for forming an image on a sheet;

a sheet conveyance section which conveys the sheet in a first conveyance direction;

a right angle reversing conveyance section which reverses front/back sides of the sheet while changing a conveyance direction of the sheet, being conveyed by the sheet conveyance direction, to a second conveyance direction perpendicular to the first conveyance direction;

a first sheet skew sensor which detects the sheet skew of the sheet being conveyed in the sheet conveyance section; and a first sheet skew correction mechanism which corrects the sheet skew while the sheet is being conveyed by the sheet conveyance section;

a second sheet skew sensor which detects the sheet skew of the sheet being conveyed in the sheet conveyance section;

a second sheet skew correction mechanism which corrects the sheet skew of the sheet while the sheet is being conveyed by the right angle reversing conveyance section; and a control section which controls a correction movement by the first and/or second sheet skew correction mechanism based on a detection result of the first or second sheet skew sensor.

5. The image forming apparatus of claim 4, wherein the first sheet skew correction mechanism corrects the sheet skew of the sheet, which is conveyed in the sheet conveyance section with lateral feeding by setting a long edge of the sheet at a leading edge in conveyance direction, as a target.

6. A sheet reversing method comprising:

conveying the sheet in a first conveyance direction;

reversing front/back sides of a sheet while conveying the sheet, by changing a conveyance direction of the sheet, being conveyed in a first conveyance direction, to a second conveyance direction perpendicular to the first conveyance direction;

executing a first sheet skew correction of the sheet, in cases where the sheet is conveyed in a first conveyance direction with lateral feeding by setting a long edge of the sheet at the leading edge in conveyance direction, based on a result of sheet skew detection by a first sheet skew sensor; and executing a second sheet skew correction of the sheet, in cases where the sheet is conveyed in a second conveyance direction with lateral feeding by setting a long edge of the sheet at the leading edge in conveyance direction, based on a result of sheet skew detecting by a second sheet skew sensor.

* * * * *